US007081276B2

(12) United States Patent
Miyamoto et al.

(10) Patent No.: US 7,081,276 B2
(45) Date of Patent: Jul. 25, 2006

(54) METHOD FOR THERMALLY SPRAYING A FILM ON AN INNER FACE OF A BORE WITH A SPIRALING VAPOR CURRENT

(75) Inventors: Noritaka Miyamoto, Toyota (JP); Eiji Itakura, Tokyo-to (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 5 days.

(21) Appl. No.: 10/713,350

(22) Filed: Nov. 17, 2003

(65) Prior Publication Data

US 2004/0094088 A1 May 20, 2004

(30) Foreign Application Priority Data

Nov. 20, 2002 (JP) ..... 2002-336320

(51) Int. Cl.
*C23C 4/08* (2006.01)
*C23C 4/12* (2006.01)

(52) U.S. Cl. ..... 427/455; 427/446; 427/456; 427/236; 427/238; 427/239

(58) Field of Classification Search ..... 427/446, 427/455, 456
See application file for complete search history.

(56) References Cited

U.S. PATENT DOCUMENTS 3,900,639 A * 8/1975 Lauterbach ..... 427/446
5,808,270 A * 9/1998 Marantz et al. ..... 219/121.47
2001/0022995 A1* 9/2001 Keller ..... 427/455

FOREIGN PATENT DOCUMENTS

JP 2002-4024 9/2002

* cited by examiner

*Primary Examiner*—Katherine Bareford
(74) *Attorney, Agent, or Firm*—Finnegan, Henderson, Farabow, Garrett & Dunner, LLP

(57) ABSTRACT

A method for thermally spraying a film on an inner face of a bore of a cylinder block. A pair of suction pipes generates a spiraling air current in the bore, creating an air flow toward the center of the bore. A spraying device sprays molten metal partaicles including fumes toward the inner face of the bore. The fumes are captured by the spiraling air current and removed from molten metal particles directing toward the inner face of the bore. Molten metal particles from which the fumes are removed form the thermally sprayed film on the inner face of the bore. High-quality thermally sprayed film scarcely containing fumes can be formed on the inner face of the bore.

3 Claims, 11 Drawing Sheets

METHOD FOR THERMALLY SPRAYING A FILM ON AN INNER FACE OF A BORE WITH A SPIRALING VAPOR CURRENT

BACKGROUND OF THE INVENTION

1. Field of the Invention

The present invention relates to a technique for forming a thermally sprayed film on an inner face of a bore of a cylinder block. In particular, the present invention relates to a technique for preventing the thermally sprayed film from peeling.

2. Description of the Related Art

A technique is known whereby, instead of attaching a cylinder liner to a bore that passes through a cylinder block of an engine, a thermally sprayed film is formed directly on an inner face of the bore. When cylinder liners are not attached, the distance between bores can be reduced, allowing the cylinder block to be miniaturized. Further, because combustion heat generated within the bore is transmitted directly to the bore, not attaching cylinder liners allows the cooling efficiency of the engine to be improved. In order to obtain a highly smoothened face, a honing process is performed on the thermally sprayed film formed on the inner face of the bore. When the thermally sprayed film processed by honing is extremely smooth, sliding resistance between the inner face of the bore and a piston can be reduced.

When the thermally sprayed film is to be formed on the inner face of the bore, a thermal spraying gun is inserted into the bore from an opening at one end thereof. The thermal spraying gun moves, while rotating, along the axial direction of the bore.

Particles of molten metal iron or the like are thermally sprayed (spray coated) towards the inner face of the bore from a thermal spraying hole provided at the tip of the thermal spraying gun. The particles sprayed from the thermal spraying hole adhere to the inner face of the bore and form the thermally sprayed film.

Particles having a small diameter—these being included among the particles that were thermally sprayed from the thermal spraying hole of the thermal spraying gun oxidize at high temperatures and form fumes (these being metal oxide particles; for example, iron oxide). When molten metal particles and fumes are sprayed, a thermally sprayed film that contains fumes is formed on the inner face of the bore. This thermally sprayed film that contains fumes has weak adhesive strength, and when the honing process is performed thereon, a portion thereof may peel away.

A technique for performing thermal spraying process while sucking air from an opening at the other end of the bore is described in Japanese Laid Open Patent Publication (TOKKAI) 20024024. The fumes are lighter than the particles that have a larger diameter. As a result, the fumes can be sucked out of the bore by performing the thermal spraying while air is being sucked from the opening of the bore. Consequently, fewer fumes are contained in the thermally sprayed film, and the adhesive strength of the thermally sprayed film is strengthened.

SUMMARY OF THE INVENTION

Performing thermal spraying process while air is being sucked from the opening of the bore can reduce the fumes contained in the thermally sprayed film. However, the thermally sprayed film formed in this manner may still peel away when the honing process is performed. Consequently, a technique is required whereby more fumes are removed from the particles, and whereby a thermally sprayed film with greater adhesive strength is formed.

A thermal spraying device of the present invention is provided with a thermal spraying gun to be inserted into a bore passing through a cylinder block from an opening at one end of the bore, and a means for generating a spiraling vapor current, the spiraling vapor current spiraling around an axis of the bore and proceeding toward an opening at the other end of the bore.

When the spiraling vapor current—wherein the vapor such as air spirals around the axis of the bore and proceeds toward the opening at the other end of the bore—is generated within the bore, the velocity of the spiraling vapor current is faster the further it is from the inner face of the bore and the closer it is to the axis of the bore (the center of the spiraling vapor current). The velocity distribution of the spiraling vapor current displays this trend because the viscosity of the vapor causes the portion of the spiraling vapor current close to the inner face of the bore to be affected thereby, this slowing the velocity of the spiraling vapor current close to the inner face of the bore. When the velocity of the spiraling vapor current is faster further from the inner face of the bore and closer to the axis of the bore, the pressure of the spiraling vapor current is lower the closer it is to the center of the spiraling vapor current (Bernoulli's theorem). As a result, a flow of vapor is generated within the spiraling vapor current whereby the vapor, while spiraling, moves towards the center of the spiraling vapor current. That is, the velocity component toward the center of the bore is generated within the spiraling vapor current.

When the vapor flows towards the center of the spiraling vapor current, fumes these being included among the particles that are thermally sprayed towards the inner face of the bore are drawn through the vapor that flows towards the center of the spiraling vapor current to gather at the center of the spiraling vapor current. The fumes that have gathered at the center of the spiraling vapor current are carried thereby towards the opening at the other end of the bore, and are sucked out of the bore. At this juncture, the particles that have a diameter larger than the fumes, these particles being heavier than the fumes and being molten, are not as affected as the fumes by the flow of the vapor current towards the center, and reach the inner face of the bore. As a result, a high-quality thermally sprayed film that scarcely contains fumes can be formed on the inner face of the bore. Consequently, the thermally sprayed film can be prevented from peeling.

In the thermal spraying method of the present invention, thermal spraying process is performed while the spiraling vapor current is generated within the bore provided in the cylinder block, the spiraling vapor current spiraling around the axis of the bore and proceeding along the axis of the bore.

When the thermal spraying method is performed while the spiraling vapor current is generated within the bore, a flow of vapor is generated in the spiraling vapor current that spirals around the axis of the bore and proceeds along the axis of the bore. The spiraling vapor current generates a velocity component toward a center of the bore. When the flow of vapor towards the center of the bore is generated, the fumes are gathered at the center of the bore, carried along the axial direction of the bore and sucked out of the bore by the spiraling vapor current. As a result, a high-quality thermally sprayed film that scarcely contains fumes can be formed on the inner face of the bore. Consequently, the thermal spraying method described above allows the formation of a thermally sprayed film that does not readily peel from the inner face of the bore.

In one embodiment, the thermal spraying gun is inserted into the bore from the opening at one end thereof, and a suction device having a plurality of suction pipes is attached to the opening at the other end thereof. While thermal spraying towards the inner face of the bore is being performed from the thermal spraying hole of the thermal spraying gun, the suction pipes of the suction device suck the vapor such as air within the bore.

In the case where a cylinder block is formed in a unified manner with a cylinder head, vapor can be sucked out from an intake port and an exhaust port while the thermal spraying operation is performed. Sucking air from the intake port and the exhaust port generates the spiraling vapor current within the bore.

DETAILED DESCRIPTION OF THE PREFERRED EMBODIMENTS

An embodiment of a thermal spraying device of the present invention and a thermal spraying method are described below with reference to figures.

Figure 1:
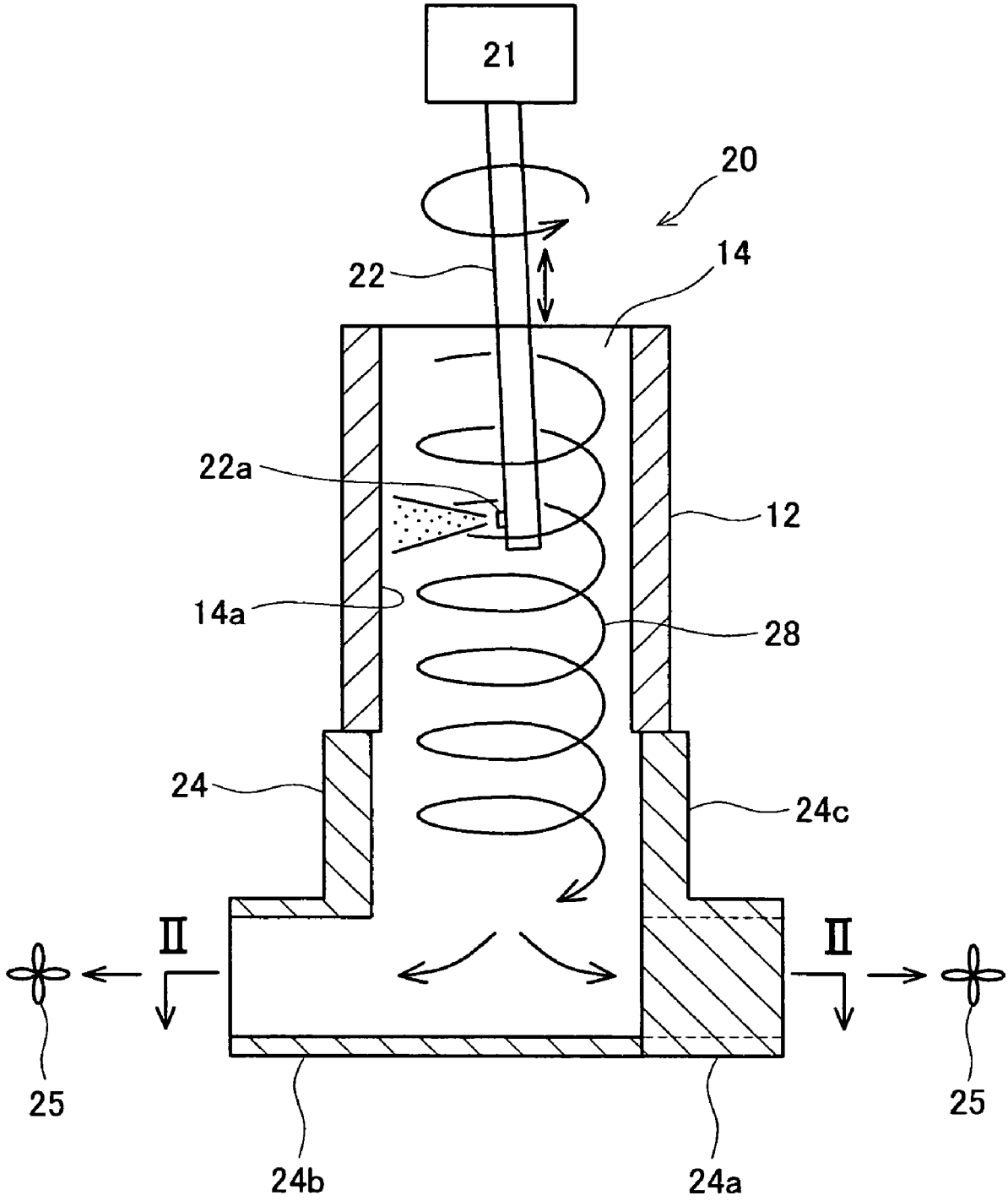
FIG. 1 shows a cross-sectional view of a thermal spraying device of the present embodiment in a state whereby it is performing thermal spraying of an inner face of a bore of a cylinder block.

As shown in FIG. 1, a thermal spraying device 20 is formed from a thermal spraying gun 22, a raising-lowering device 21 for the thermal spraying gun 22, a suction adaptor 24, and suction fans 25, etc. The thermal spraying gun 22 is inserted into a bore 14 passing through a cylinder block 12 from an upper opening of the bore 14. While being supported by the raising-lowering device 21, the thermal spraying gun 22 rotates while moving up and down. A thermal spraying hole 22*a* opens into a side face at a tip of the thermal spraying gun 22. An electrode having a positive pole and a negative pole is provided within the thermal spraying hole 22*a*. Fine iron powder, argon gas, and electric power are supplied to the thermal spraying gun 22 via the raising-lowering device 21. An axis of the thermal spraying gun 22 is inclined relative to an axis of the bore 14. Changing the angle of inclination of the thermal spraying gun 22 allows the distance between the thermal spraying hole 22*a* and an inner face 14*a* of the bore 14 to be adjusted.

Figure 2:
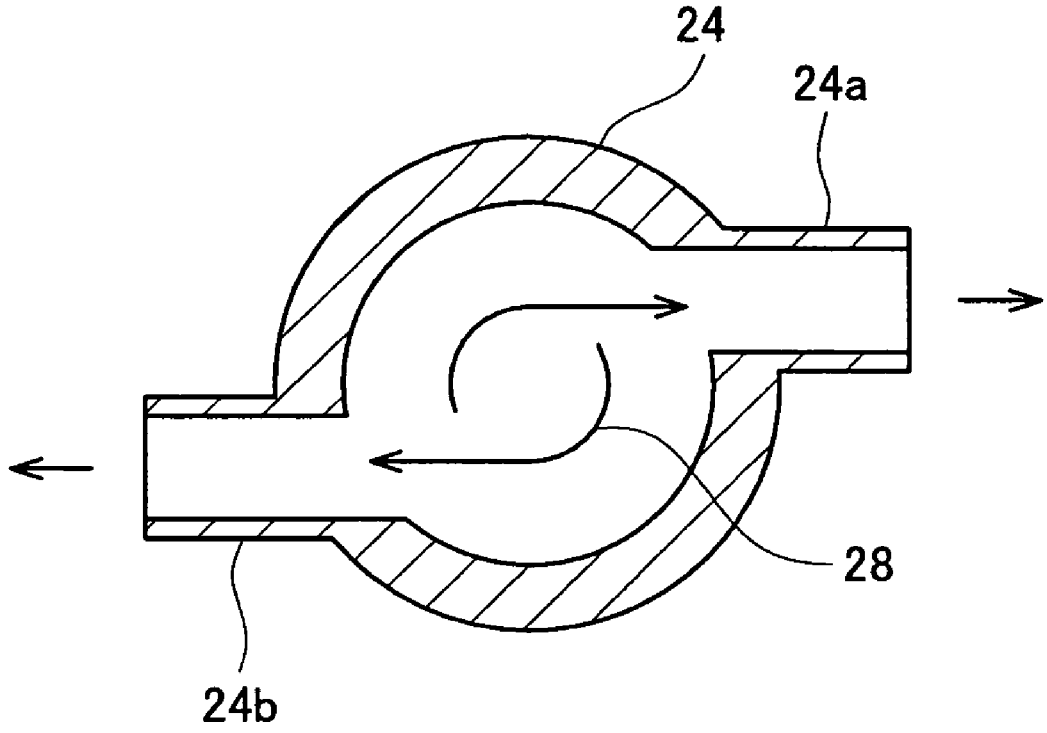
FIG. 2 shows a cross-sectional view along the line II—II of FIG. 1.

The suction adaptor 24 is attached to a lower opening of the bore 14. As shown in FIG. 2, the suction adaptor 24 is provided with a suction pipe 24*a*, a suction pipe 24*b*, and a duct 24*c* (FIG. 1) that has almost the same internal diameter as the bore 14. As shown in FIG. 2, the axes of the suction pipes 24*a* and 24*b* are arranged in parallel to each other so as to sandwich the axis of the duct 24*c*. The axis of the bore 14 intervenes between the axes of sucking pipes 24*a* and 24*b*. The suction pipes 24*a* and 24*b* are connected with the suction fans 25.

When a high voltage is applied to the electrode of the thermal spraying gun 22, electrical discharge occurs within the thermal spraying hole 22*a*. If the iron powder and the argon gas are supplied to the thermal spraying gun 22 that is in this state, high temperature plasma and particles in which the iron powder has melted are sprayed with great force from the thermal spraying hole 22*a* onto the inner face 14*a* of the bore 14. At this juncture, particles having a small diameter—these being included among the particles that are thermally sprayed—oxidize when the temperature rises, and become fumes. The thermal spraying gun 22 rotates and moves up and down within the bore 14 while performing thermal spraying, and a thermally sprayed film is formed on the entire inner face 14*a* of the bore 14.

When the suction fans 25 are operated, air within the bore 14 is sucked therefrom via the suction pipes 24*a* and 24*b* of the suction adaptor 24. As described above, the axes of the suction pipes 24*a* and 24*b* are arranged in parallel to each other so as to sandwich the axis of the duct 24*c*. As a result, when the suction pipes 24*a* and 24*b* suck the air, a spiraling air current 28 is generated within the bore 14. The spiraling air current 28 spirals around the axis of the bore 14 and proceeds toward the lower opening of the bore 14.

Air viscosity causes the portion of the spiraling air current 28 close to the inner face 14*a* of the bore 14 to be affected by this inner face 14*a*, resulting in this portion being slower than the rest of the air within the bore 14. As a result, the velocity of the spiraling air current 28 tends to be faster the further it is from the inner face 14*a* and the closer it is to the center of the spiraling air current 28. Consequently, the pressure distribution within the spiraling air current 28 is such that the pressure is lower the further it is from the inner face 14*a* and the closer it is to the center of the spiraling air current 28 (Bernoulli's theorem). As a result, a flow of air is generated within the spiraling air current 28 that flows, while spiraling, towards the center of the spiraling air current 28.

When the flow of air towards the center of the spiraling air current 28 within the bore 14 is generated, the fumes, which have a low inertial force due to their lightness, are carried by the air and gather at the center of the spiraling air current 28. The fumes that have gathered at the center of the spiraling air current 28 are sucked to the exterior from the lower opening of the bore 14 via the suction adaptor 24.

The particles that have a large diameter do not become hot enough to become fumes, and are sprayed in a molten state towards the inner face 14*a* of the bore 14. The particles with a large diameter also have a large inertial force due to their weight. As a result, the flow towards the center of the spiraling air current 28 scarcely affects the particles with a large diameter, and these reach the inner face 14*a* of the bore 14. Consequently, a high-quality thermally sprayed film that scarcely contains fumes can be formed on the inner face 14*a* of the bore 14. As a result, the thermally sprayed film is prevented from peeling when the honing process is performed.

Figure 3:
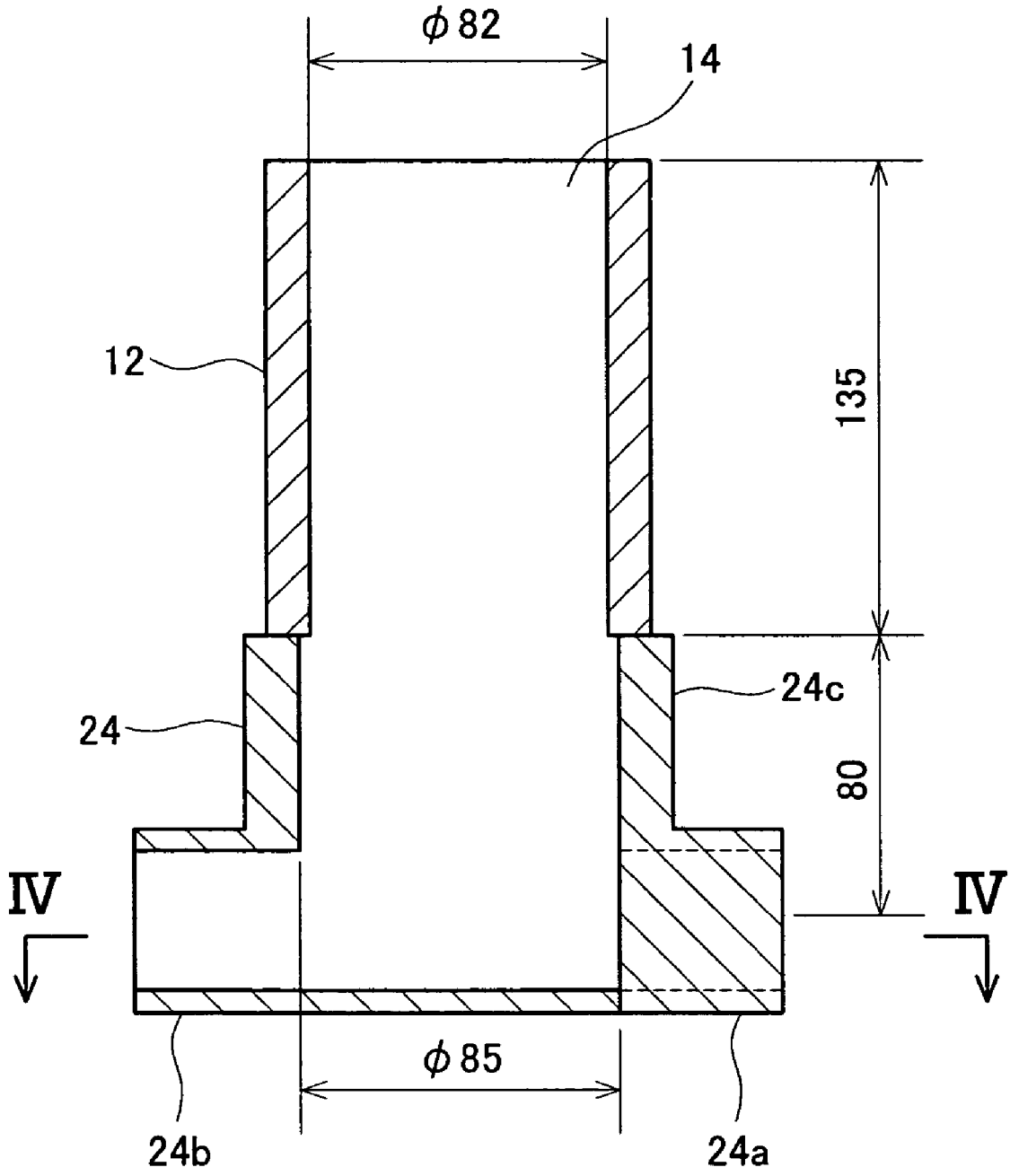
FIG. 3 shows a cross-sectional view giving dimensions of the thermal spraying device of the present embodiment and the cylinder block.
Figure 4:
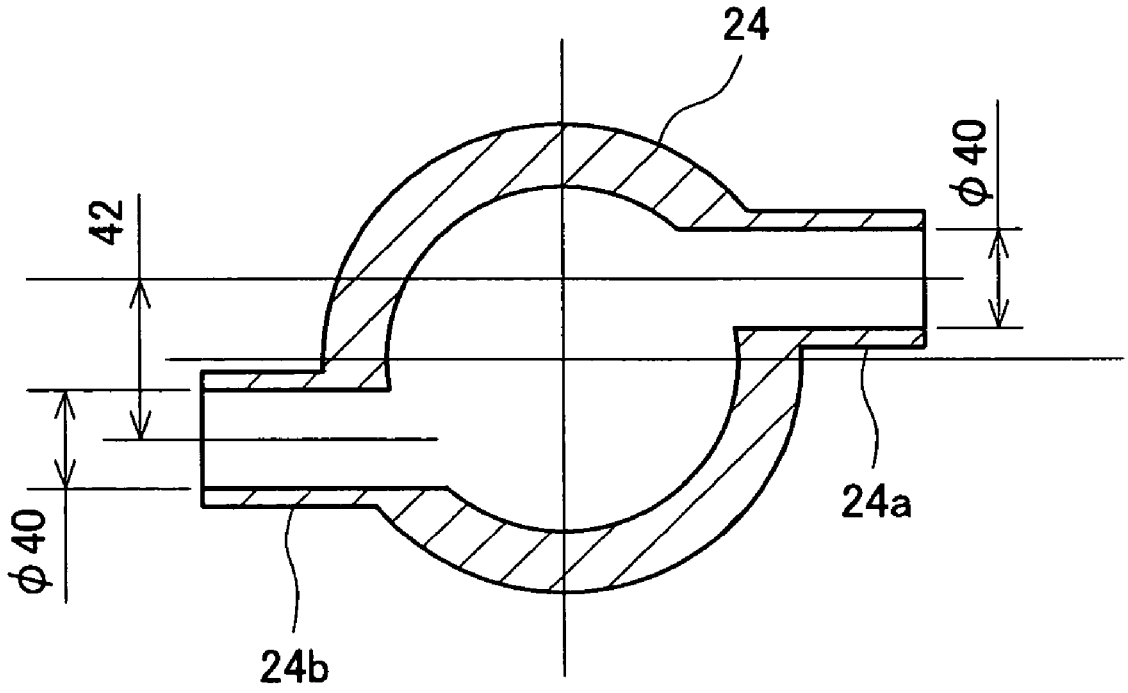
FIG. 4 shows a cross-sectional view along the line IV—IV of FIG. 3.

FIG. 3 and FIG. 4 show the dimensions in mm of the cylinder block 12 in which the thermally sprayed film is formed, and of the suction adaptor 24 used for sucking air from the bore 14. The composition of the particles used in the thermal spraying is: carbon (C) 0.4% by weight, molybdenum (Mo) 2% by weight, chromium (Cr) 12% by weight, and the remainder being iron (Fe).

Figure 5:
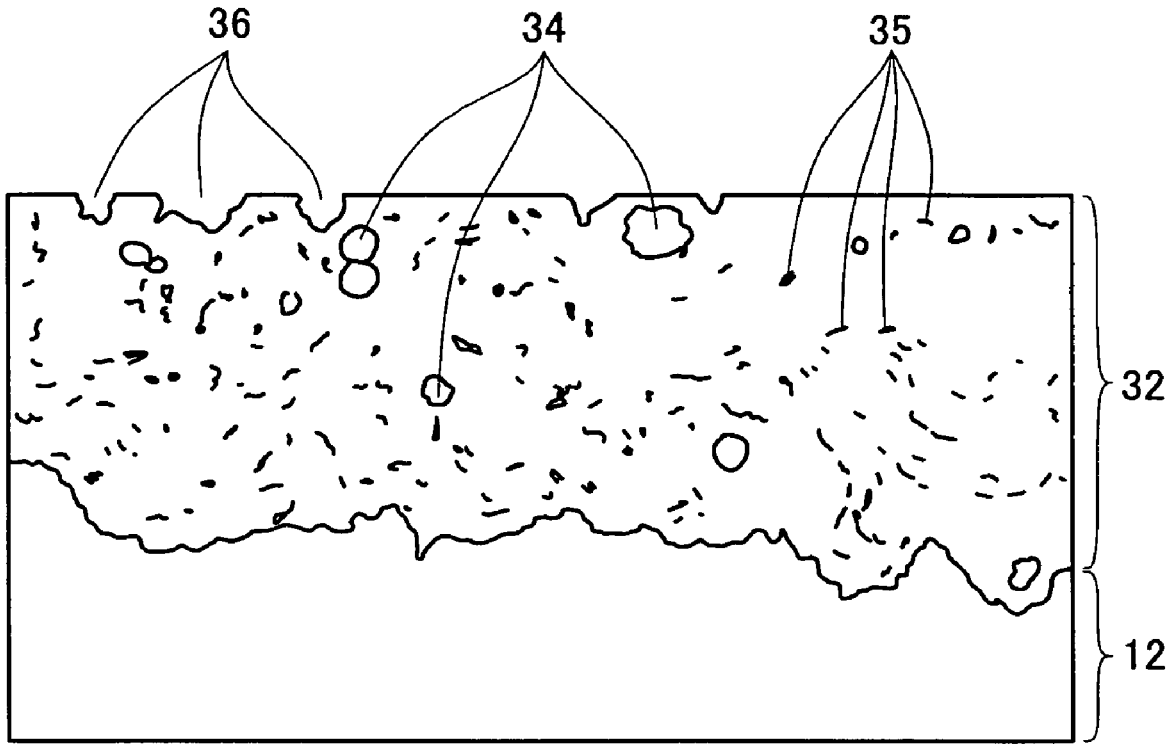
FIG. 5 is a detailed cross-sectional view showing a thermally sprayed film and the cylinder block in the case where the thermally sprayed film was formed without air flowing through the bore.

The high-quality thermally sprayed film formed by using the thermal spraying device 20 of the present embodiment will be described while being compared with the thermally sprayed film formed by the conventional thermal spraying device. FIG. 5 is a cross-sectional view showing the cylinder block 12 and a thermally sprayed film 32 in the case where the honing process was performed after the thermally sprayed film was formed without air flowing through the bore 14. The thickness of the thermally sprayed film 32 is approximately 0.1 mm. Non-molten particles 34 that did not melt due to their diameter being too large are represented by the circular or oval shapes, and fumes 35 are represented by the small lines. As is clear from FIG. 5, concave peeled-away holes 36 are formed in a surface of the thermally sprayed film 32. These peeled-away holes 36 occur as a result of many fumes 35 being contained in the thermally sprayed film 32, thus weakening the adhesive strength of the thermally sprayed film 32 so that portions thereof peel away when the honing process is performed. When a piston is moved back and forth within the bore 14, the presence of the peeled-away holes 36 greatly increases the sliding resistance between the piston and the inner face 14*a* of the bore 14.

Figure 6:
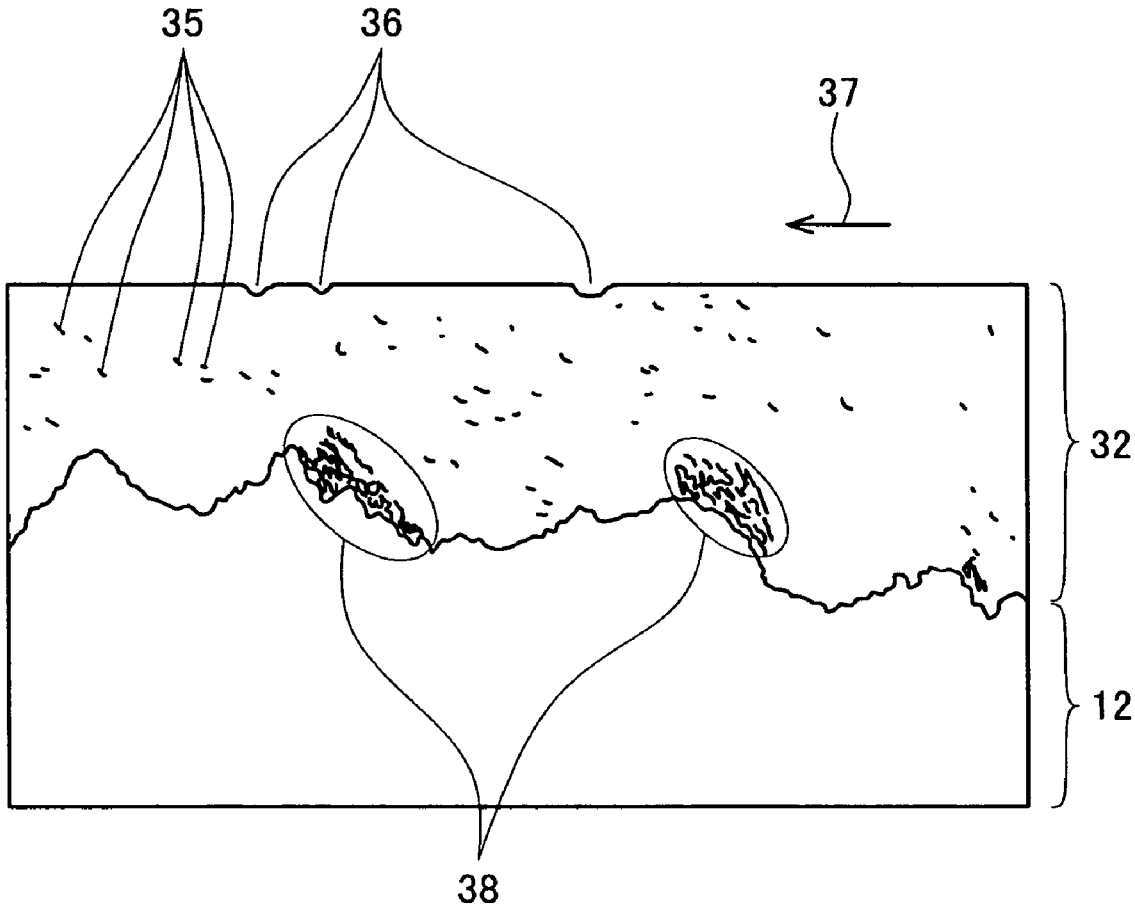
FIG. 6 is a detailed cross-sectional view showing a thermally sprayed film and the cylinder block in the case where the thermally sprayed film was formed while air was flowing through the bore in the axial direction thereof.

FIG. 6 is a cross-sectional view showing the cylinder block 12 and the thermally sprayed film 32 in the case where the honing process was performed after the thermally sprayed film was formed while air was flowing through the bore 14 in the axial direction thereof (the direction of the arrow 37). The flow velocity along the axial direction of the bore 14 is 8 m/s. As is clear from FIG. 6, the fumes 35 in the thermally sprayed film 32 are fewer than in the thermally sprayed film 32 shown in FIG. 5 that was formed without air flowing along the bore 14. Further, since thermal spraying is performed while air is flowing in the direction of the arrow 37, the fumes accumulate on members 38 that protrude from the cylinder block 12 for the fumes to catch thereon. The non-molten particles 34 shown in FIG. 5 are not observed because their size is greater than the fumes and consequently they do not catch on the protruding members. The peeled-away holes 36, although small, are still formed in the surface of the thermally sprayed film 32.

Figure 7:
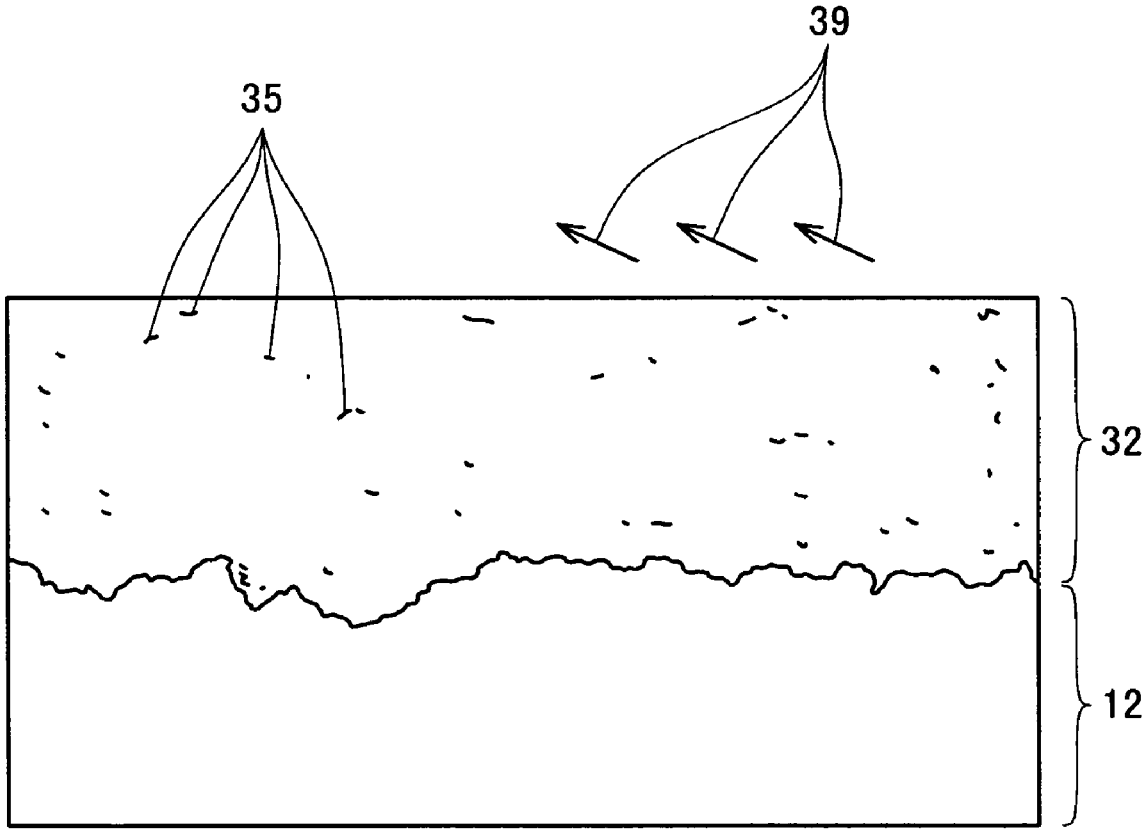
FIG. 7 is a detailed cross-sectional view showing a thermally sprayed film and the cylinder block in the case where the thermally sprayed film was formed while air flowing through the bore formed a spiraling air current.

FIG. 7 is a cross-sectional view showing the cylinder block 12 and the thermally sprayed film 32 in the case where the honing process is performed after the thermally sprayed film 32 was formed while air flowing through the bore 14 formed the spiraling air current 28 wherein air spirals around the axis of the bore 14 and approaches the lower opening thereof. The flow velocity of the air along the axial direction of the bore 14 is 8 m/s. While the spiraling air current 28 spirals, an air-flow (in the direction of the arrow 39) towards the center thereof is generated. As is clear from FIG. 7, the fumes 35 are scarcely contained in the thermally sprayed film 32, and the peeled-away holes 36 are not formed in the surface of the thermally sprayed film 32. In this manner, a high-quality thermally sprayed film can be formed by using the thermal spraying device 20 of the present invention.

Erosion experiments were performed wherein the adhesive strength of the thermally sprayed film was identified when the thermally sprayed film was formed: (1) in a state whereby air did not flow along the bore 14; (2) in a state whereby air flowed along the axial direction of the bore 14; (3) in a state whereby the spiraling current 28 was generated wherein air flowed along the axial direction of the bore 14 while spiraling around the axis thereof. The results of these experiments are described below.

In the erosion experiments, the thermally sprayed film was formed in the cylinder blocks 12 under one of the conditions (1) to (3) described above. Then the weight of each cylinder block 12 was measured. Next, a blasting device was inserted into the bore. The blasting device was provided with a bar-shaped main body and a nozzle provided in a side face of a tip of the main body. The blasting device was positioned such that an axis thereof was identically located with the axis of the bore 14. The blasting device was rotated at 500 rpm while moving along the axial direction of the bore 14 at a velocity of 3 mm/s. Water pressure in the nozzle portion was 173 MPa. One interval constituted moving the nozzle, while water was blasting therefrom, from the upper portion to the lower portion of the bore 14, then from the lower portion to the upper portion thereof, and then drying the cylinder block 12. Three intervals were repeated. Finally, the weight of the cylinder block 12 was measured, and the difference from the weight measured at the beginning of the erosion experiment was ascertained. The degree of difference corresponds to the degree of erosion, and the degree of adhesive strength of the thermally sprayed film.

Figure 8:
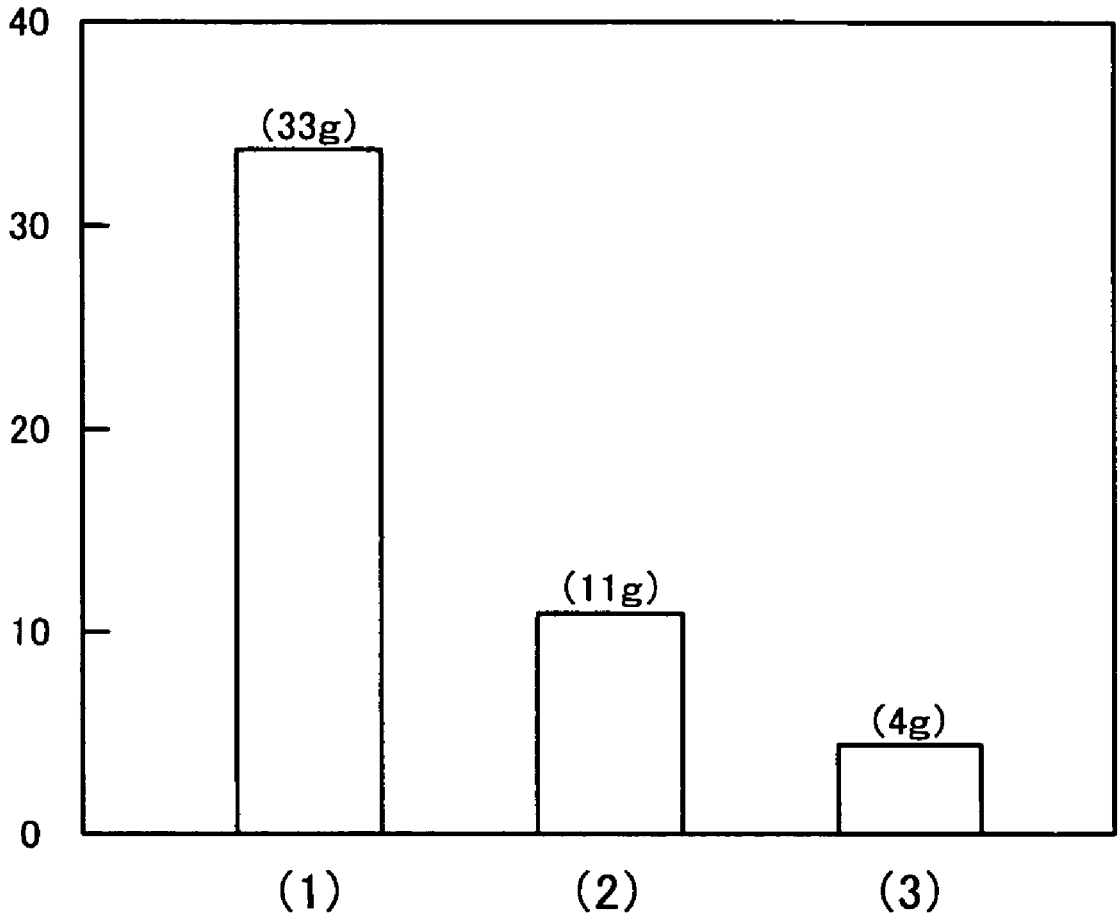
FIG. 8 shows results of erosion experiments on the thermally sprayed film.

FIG. 8 shows the results of the erosion experiments. The vertical axis shows eroded weight (g). On the horizontal axis, (1) is the thermally sprayed film formed in a state whereby air did not flow along the bore 14, (2) is the thermally sprayed film formed in a state whereby air flowed along the axial direction of the bore 14, and (3) is the thermally sprayed film formed in a state whereby the spiraling air current 28 was generated wherein air flowed along the axial direction of the bore 14 while spiraling around the axis thereof. As shown in FIG. 8, the thermally sprayed film of (1) has an eroded weight of 33 g, the thermally sprayed film of (2) has an eroded weight of 11 g, and the thermally sprayed film of (3) has an eroded weight of 4 g. As is clear from these results, performing the thermal spraying while the spiraling air current 28 is generated within the bore 14 allows a high-quality thermally sprayed film having greater adhesive strength than the conventional example to be formed on the inner face 14*a* of the bore 14.

Figure 9:
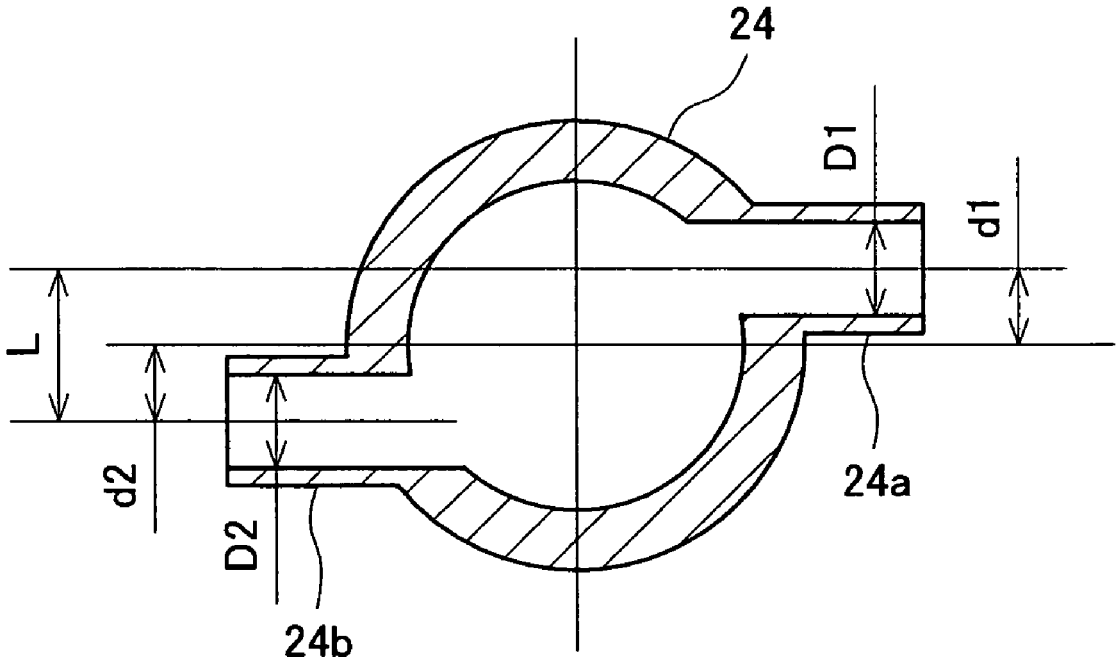
FIG. 9 shows a cross-sectional view giving dimensions of a suction adaptor of the present embodiment.

The strength of the spiraling air current 28 formed within the bore 14 is dependent upon the diameter of the suction pipes 24*a* and 24*b* of the suction adaptor 24 and the distance between the axes thereof. The diameter and the distance between the axes of the preferred suction pipes 24*a* and 24*b* that form the suction adaptor 24 invented by the present inventors is shown in the following formula that uses the symbols shown in FIG. 9.

$$L=d_1+d_2=0.8\ (D_1+D_2)/2$$

Figure 10:
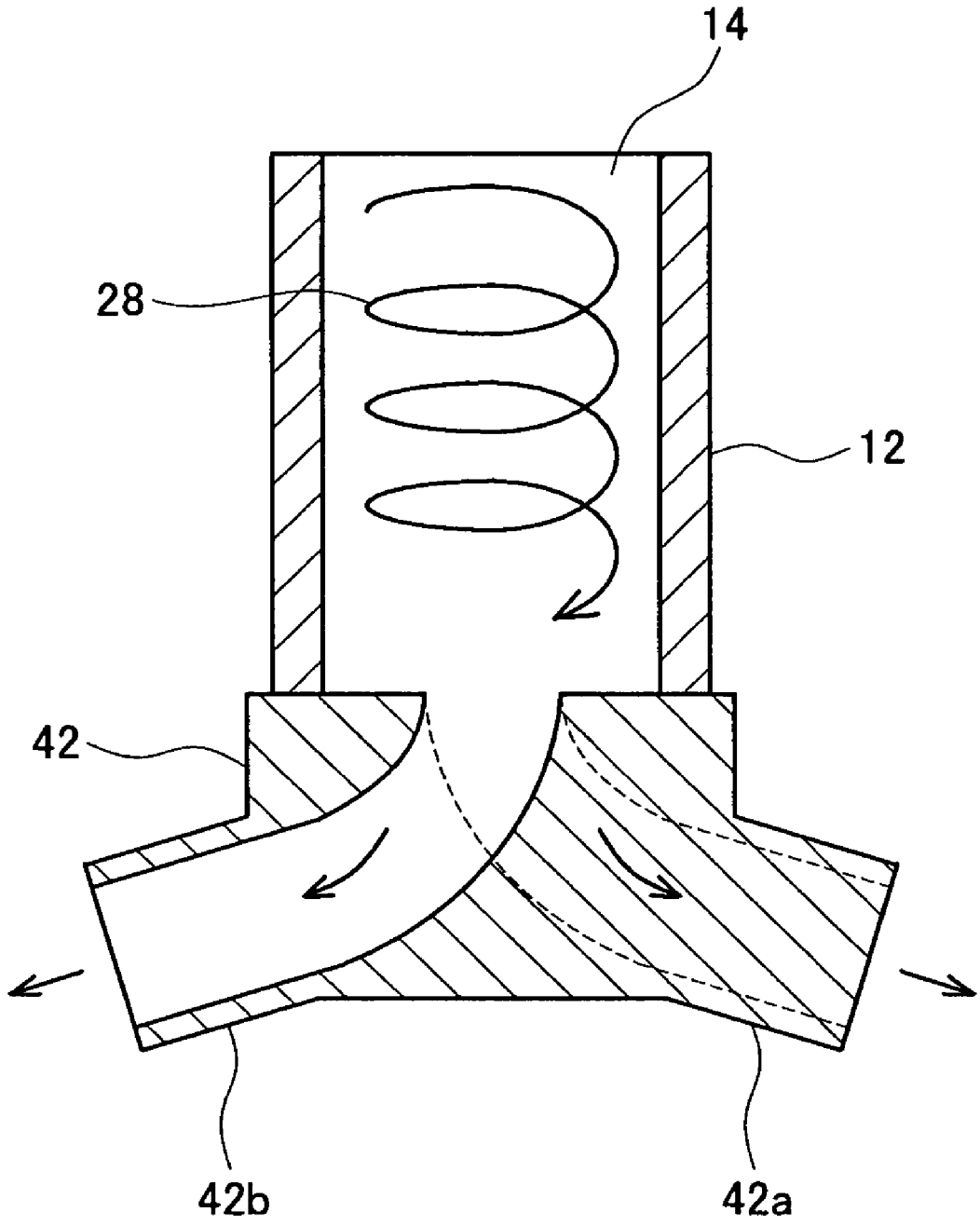
FIG. 10 shows a cross-sectional view of the cylinder block and the suction adaptor of present embodiment.

As shown in FIG. 10, it is possible to use a suction adaptor 42 provided with suction pipes 42*a* and 42*b* that curve smoothly and are inclined in a downward direction. Air resistance (pressure loss) is smaller with this type of suction adaptor 42 than with the suction adaptor 24 described above.

As a result, more air can be sucked out using the suction adaptor 42, and a stronger spiraling air current 28 can be generated within the bore 14.

Figure 11:
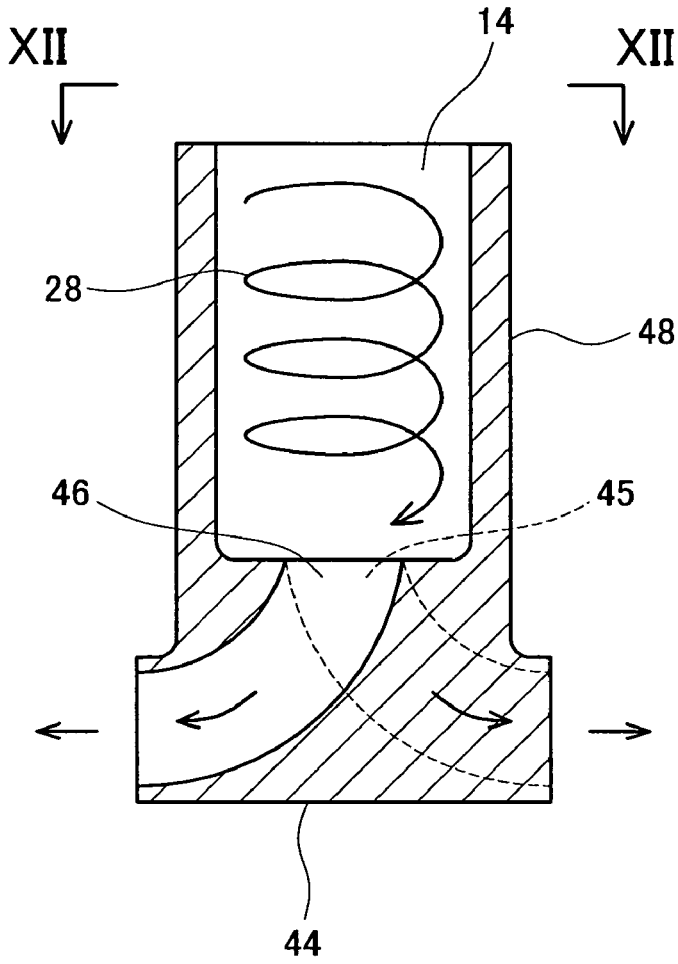
FIG. 11 shows a cross-sectional view of a cylinder block formed in a unified manner with a cylinder head of the present embodiment.
Figure 12:
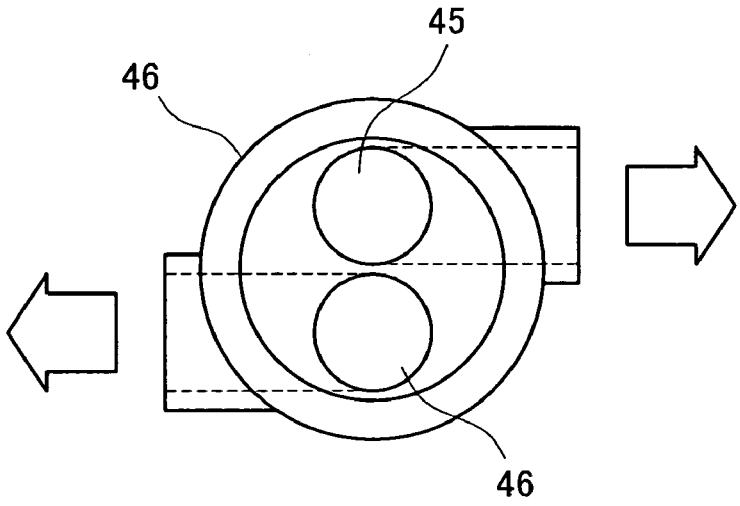
FIG. 12 shows a view along the line XII—XII of FIG. 11.

As shown in FIGS. 11 and 12, in a cylinder block 48 formed in a unified manner with a cylinder head 44, the spiraling air current 28 can be generated within the bore 14 when air is sucked out from an intake port 45 and an exhaust port 46. As a result, in this type of cylinder block 48, thermal spraying is performed while the spiraling air current 28 is generated without using the suction adaptor 24, and a high-quality thermally sprayed film can be formed.

A specific example of an embodiment of the present invention is presented above, but this merely illustrates some possibilities of the invention and does not restrict the claims thereof. The art set forth in the claims includes variations, transformations and modifications to the specific example set forth above.

Furthermore, the technical elements disclosed in the present specification or figures may be utilized separately or in all types of conjunctions and are not limited to the conjunctions set forth in the claims at the time of submission of the application. Furthermore, the art disclosed in the present specification or figures may be utilized to simultaneously realize a plurality of aims or to realize one of these aims.

The invention claimed is:

1. A method for forming a thermally sprayed film on an inner face of a bore of a cylinder block, comprising:

generating a spiraling vapor current that spirals around an axis of the bore and proceeds toward an opening of the bore by sucking air from a pair of suction passages that communicate with an interior of the bore, axes of the suction passages being offset from the axis of the bore in opposite directions;

spraying molten metal particles from a thermal spraying gun inserted into the bore towards the inner face of the bore with the spiraling vapor current generated in the bore; and forming the thermally sprayed film on the inner face with the sprayed molten particles.

2. A method as set forth in claim 1, wherein the spiraling vapor current generates a velocity component toward a center of the bore.

3. A method as set forth in claim 2, wherein the flow of vapor toward the center of the bore prevents oxidized metal particles from adhering to the inner face of the bore.

* * * * *

UNITED STATES PATENT AND TRADEMARK OFFICE

CERTIFICATE OF CORRECTION

PATENT NO. : 7,081,276 B2
APPLICATION NO. : 10/713350
DATED : July 25, 2006
INVENTOR(S) : Noritaka Miyamoto et al.

It is certified that error appears in the above-identified patent and that said Letters Patent is hereby corrected as shown below:

Title page, Item (57), line 5 - “partaicles” should read --particles--.

Signed and Sealed this

Sixth Day of March, 2007

JON W. DUDAS
*Director of the United States Patent and Trademark Office*